US007513026B2

(12) United States Patent
Thomanek

(10) Patent No.: US 7,513,026 B2
(45) Date of Patent: Apr. 7, 2009

(54) METHOD FOR ROLLING THIN AND THICK SLABS MADE OF STEEL MATERIALS INTO HOT-ROLLED STRIP

(75) Inventor: Erik Thomanek, Düsseldorf (DE)

(73) Assignee: SMS Demag AG, Düsseldorf (DE)

( * ) Notice: Subject to any disclaimer, the term of this patent is extended or adjusted under 35 U.S.C. 154(b) by 581 days.

(21) Appl. No.: 10/544,606

(22) PCT Filed: Jan. 30, 2004

(86) PCT No.: PCT/EP2004/000832

§ 371 (c)(1),
(2), (4) Date: Aug. 4, 2005

(87) PCT Pub. No.: WO2004/069440

PCT Pub. Date: Aug. 19, 2004

(65) Prior Publication Data

US 2006/0143897 A1 Jul. 6, 2006

(30) Foreign Application Priority Data

Feb. 4, 2003 (DE) ..... 103 04 318

(51) Int. Cl.
*B23P 17/00* (2006.01)

(52) U.S. Cl. ..... 29/527.7; 29/33 C; 72/226; 72/366.2; 72/379.2; 700/148

(58) Field of Classification Search ..... 29/527.7, 29/33 C; 72/379.2, 200, 201, 226, 366.2, 72/234; 700/148
See application file for complete search history.

(56) References Cited

U.S. PATENT DOCUMENTS 3,648,359 A * 3/1972 Dennis ..... 29/527.7
5,991,991 A * 11/1999 Pleschiutschnigg ..... 29/33 C
6,941,636 B2 * 9/2005 Dachtler et al. ..... 29/527.7

FOREIGN PATENT DOCUMENTS

DE 10109223 C1 * 8/2002
DE 02/068137 9/2002
EP 0 584 605 3/1994
EP 0 726 101 8/1996
EP 0 867 239 9/1998
JP 58 112603 A * 7/1983

* cited by examiner

*Primary Examiner*—Jermie E Cozart
(74) *Attorney, Agent, or Firm*—Friedrich Kueffner

(57) ABSTRACT

A method for rolling thin and/or thick slabs made of steel materials into hot-rolled strip, which were previously cast as thin or thick slabs in a continuous casting machine, heated to rolling temperature in a pusher furnace or in a walking-beam furnace, and rolled in a common rolling train, then cooled and wound into coils. The method is carried out in a continuous manner at maximum capacity of the roughing train according to the quality standard of the hot-rolled strip while roller wear is reduced due to the fact that the roughing train is formed inline by roughing stands and finishing stands into which thin slab sections or thick slab sections are introduced at a suitable point of the roughing train according to the thickness thereof.

15 Claims, 2 Drawing Sheets

METHOD FOR ROLLING THIN AND THICK SLABS MADE OF STEEL MATERIALS INTO HOT-ROLLED STRIP

BACKGROUND OF THE INVENTION

The invention concerns a method for rolling thin and/or thick slabs made of steel materials into hot-rolled strip, which were previously cast as thin or thick slabs in a continuous casting machine, heated to rolling temperature in a pusher furnace or in a walking-beam furnace, and rolled in a rolling train, then cooled and wound into coils.

In general, only one and the same product is always produced in a rolling train, possibly with different dimensions, in the case of hot-rolled strip, with different widths or thicknesses. Efforts to increase the capacity utilization of a rolling train have resulted in the use of so-called "mixed rolling" since 2002, i.e., the rolling of significantly different strand thicknesses and strand widths. This has made it possible to lower the capital investment for a plant and the cost of the rolled product.

WO 02/068137 A1 describes a method for operating a continuous casting and rolling plant, in which a continuous casting and rolling plant is defined by the combination of the processes "slab casting" and "hot rolling", which are otherwise separate in conventional steel plate production. Continuous casting and rolling is based on a slab production line (continuous casting machine) and a rolling train, in which a slab feeding device that is independent of the slab production line is provided. Several casting machines are necessary to achieve full capacity. A maximum possible production output is only possible either with a plant with two casting installations or with a twin-strand casting installation. Nevertheless, the rolling train always rolls faster than casting can be accomplished in a full casting operation. Unused production gaps arise from set-up times of the casting machine (tundish, mold or segment changes, and maintenance work). During production breaks in the slab production line, stored slabs can be fed into the rolling train to fill the production break. The stored slabs can only originate from a second continuous casting machine. In the production of thin slabs on a thin slab production line and in the production of thick slabs on a thick slab production line, a separate continuous casting machine is necessary for thin slabs and for thick slabs, and this in turn results in increased capital investment. Accordingly, the desired coupling of the continuous casting machine with a (finishing) rolling train also cannot be fully achieved in an economical way by means of two separate continuous casting machines for thin slabs and thick slabs or by means of a twin-strand continuous casting machine, because the higher investment costs are again reflected in the final product. However, the rolling of thick slabs in a separate roughing train is especially unfavorable. In this case, the hot-rolled strip is wound into coils after rolling, transferred in a coil box to a holding furnace, and fed from there to the finishing rolling train. This operating method results in higher production costs, loss of time and energy, and a reduction of production output. Therefore, in accordance with the state of the art, the only remaining option for increasing plant utilization is the filling of production breaks in the time intervals arising in the continuous casting machines. In this regard, only the specifically shorter rolling times relative to the specifically longer casting times can be utilized to increase the rolling train output.

SUMMARY OF THE INVENTION

The objective of the invention is to better adapt the continuous casting process and the rolling process to each other in such a way that the rolling output is increased by largely continuous rolling (maximum utilization of the rolling trains), while at the same time product engineering with the least capital investment is taken into consideration, energy savings are achieved, and the method is subsequently introduced into existing rolling mills.

In accordance with the invention, this objective is achieved by continuously passing successive thin slab sections from a single thin slab continuous casting machine, which is installed or is already present upstream of an existing rolling train, which thin slab sections emerge from the pusher furnace, or thick slab sections, which emerge from the walking-beam furnace and are introduced transversely into the rolling train, or thin slab sections directly into the thickness-reducing roughing stands or through started-up roughing stands or directly in front of the first rolling stand of the finishing rolling train, and finish rolling them in a finishing rolling train located in a pass line with the roughing stands, and only then winding them into coils. Apart from operationally related maintenance work, this eliminates all production breaks caused by casting and/or rolling, and, above all, it allows optimum product engineering. Taking the product engineering into consideration, the maintenance work that is to be expected can also be planned more efficiently. The casting process and rolling process as well as the plant engineering can be interrelated with the desired final product from the very start. All together, stable conditions for casting, rolling, and maintenance work are achieved in this way. Fewer geometric defects occur in the hot-rolled strip. There is an overall reduction of roll wear. In addition, cost savings are achieved due to a significantly higher production throughput. The result is a continuous material flow in the continuous casting installation and the (previously separate) rolling train all the way to the production of a hot-rolled strip of a predetermined grade, quality, and amount in the form of a coiled product. Moreover, significant investment cost savings are realized by a subsequently built thin slab continuous casting machine. The thick slab sections can also be brought in from an outside source or brought in from an already existing casting machine for thick slab sections that is located elsewhere in the plant.

The advantageous product engineering can be designed in such a way that, within a rolling campaign, a percentage of thin slabs and a complementary percentage of thick slabs are continuously fed in succession to the common rolling train and rolled out. In this regard, the specific number of thin slabs or thick slabs is determined on the basis of the given quality standard of the hot-rolled strip to be produced, a reduction of the roll wear, and a maximum production throughput.

Other advantageous features consist in the priority rolling of the thin slabs, which, as they emerge from the continuous casting machine, are passed directly through the pusher furnace, and, with the roughing stands open, into the finishing rolling train to be finish rolled. With respect to the casting speed, the casting of thin slabs comes closest to the rolling speed.

In another improvement, the slab sections are removed from a temporary storage facility for thick and/or thin slabs, which is located upstream of the walking-beam furnace, thermally prepared, and rolled out in the finishing rolling train located in the common pass line. If the source of the slabs is a remotely located continuous casting installation for slabs, a homogenizing heat treatment must also be carried out.

In this regard, it is also advantageous for the walking-beam furnace to be charged in a way that is interrelated with the thick slabs, which are sorted according to width and thickness. This increases the flexibility of the process and makes product engineering easier.

In accordance with other features, product engineering can also be assisted by casting and temporarily storing the thick slabs in a manner that is interrelated with the required widths and/or thicknesses.

In a refinement of the method, special cases that arise during product engineering and operating states that cannot be foreseen even during production can be taken into consideration if thick slabs outside the limits of the entire rolling program of a pass line are cast in terms of the average dimensions of the hot-rolled strip market and placed in temporary storage. This provides an additional option for product engineering, and even though there is currently no demand for this option, it represents an average of the hot-rolled strip market and can be easily incorporated in the production process. Thus, basically two types of storage are obtained: one planned reserve and one reserve for operating conditions that cannot be planned.

Furthermore, it is advantageous for the thick or thin slabs in the temporary storage facility to be sorted according to width, quality, and/or quality group. This results in savings in feed time to the pusher furnace or the walking-beam furnace and is also helpful in product engineering. For example, groups can be formed as follows:

- a group for a planned production to allow thin slab production to be designed in an optimum way according to the rolling conditions,
- a group for compensation of operating states that cannot be planned to allow rolling conditions to be designed in an optimum way in conjunction with thin slab production.

In order to assist the matching of the thickness of the rolling stock to the pass programs, it is provided that, in a downstream finishing rolling train, an intermediate product is introduced, which was cast and/or rolled in thickness and width as an approximately thin slab or an approximately thick slab. Small thickness differences can also be determined by an adaptation of the pass programs in the roughing stands or the finishing rolling train or, on the other hand, by the slab thickness.

Further matching of the slab thickness to the initial rolling pass can be accomplished by using the continuous casting molds to dimension the casting profile in width and/or in thickness for optimum shaping of the intermediate product. In this way, the intermediate product can be adjusted before the finishing rolling train.

An independent alternative consists in operating the continuous casting machine and the rolling train in the CSP process.

Another independent alternative consists in operating the continuous casting machine with liquid core reduction (LCR).

Further adaptation of thin slabs and thick slabs to the initial rolling pass can be undertaken in such a way that the thin slab is introduced between two roughing stands before the finishing rolling train, into which a thicker slab is introduced as a transition slab. This case can arise if, for individual reasons, the thin slab cannot be fed into the rolling train at the optimum point. The slab is then fed into the rolling train some distance before the finishing rolling train. The thickness of the thin slab can be increased, and in this case the pass programs of the roughing stands are adjusted. For example, two roughing stands in tandem arrangement can be operated for a thick slab with a thickness of 70 mm and/or roughing stands can be opened, as has been described.

It is further proposed that a thin slab or a thick slab, each with a thickness of 30 mm to 60 mm, be introduced into the finishing rolling train as a transition slab.

In a case of this type, it is further provided that the thin slab is introduced between two roughing stands with increased thickness with increasing distance.

Specific embodiments of the invention are illustrated in the drawings and explained in greater detail below.

DETAILED DESCRIPTION OF THE INVENTION

Figure 1:
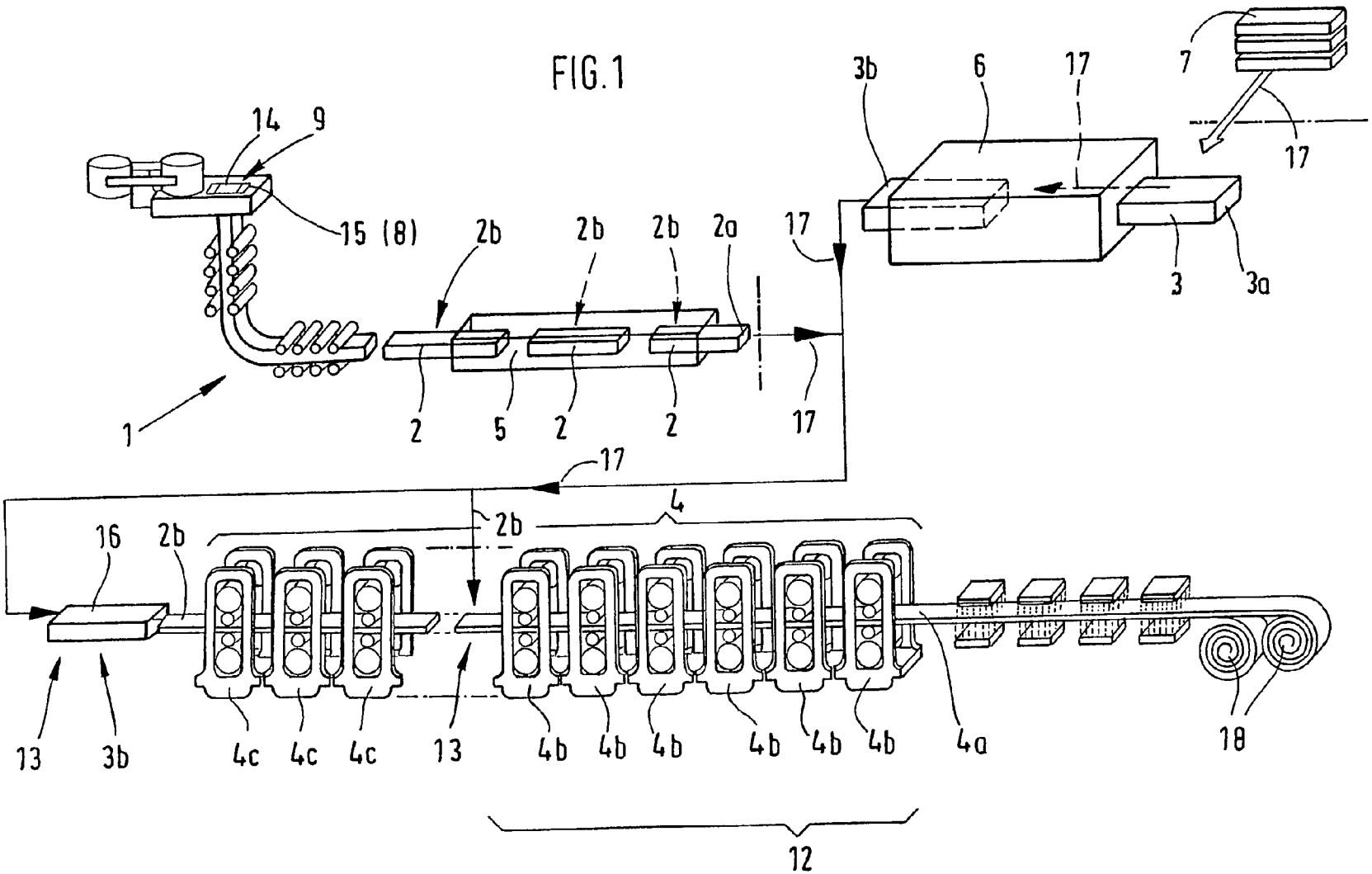
FIG. 1 shows a perspective view of a continuous casting and rolling plant.

In a first process section, the continuous casting is carried out in a continuous casting machine 1 for thin slabs 2 or thick slabs 3 made of steel materials (carbon steels, alloy steels, and the like). Thin slabs 2 are defined as slabs with slab cross sections 2*a* with a thickness of about 30-70 mm. The thick slab 3 has a slab cross section 3*a* with a thickness of about 70-300 mm. A transition slab 16, which will be described below, in front of several roughing stands 4*c* of a rolling train 4 has the thickness 9 of a thin slab 2 of about 30 mm and can therefore be fed directly into a finishing rolling train 12.

After casting in the continuous casting machine 1, the thin slab 2 and the thick slab 3, which are made of steel materials, are rolled into hot-rolled strip 4*a* in a common rolling train 4 and wound into coils 18. After being continuously cast, the thin slab 2 and the thick slab 3 are heated to the initial pass temperature of the first rolling stand 4*b* or 4*c* and homogenized with respect to temperature in a pusher furnace 5 or a walking-beam furnace 6 as thermal preparation for the rolling process and are then introduced into the pass line 4.

The process proceeds basically as follows: Successive thin slab sections 2*b* from a single thin slab continuous casting machine 1, which is installed as new construction or is already present upstream of an existing rolling train 4, which thin slab sections emerge from the pusher furnace 5, or thick slab sections 3*b*, which emerge from the walking-beam furnace 6 and are introduced transversely into the rolling train 4, or thin slab sections 2*b* are continuously introduced directly into the reducing roughing stands, which reduce their thickness 9, or through started-up roughing stands 4*c* or directly in front of the first rolling stand of the finishing rolling train 12, finish rolled in a finishing rolling train 12 located in a pass line 4 with the roughing stands 4*c*, and only then wound into coils 18 after they have been cooled in laminar cooling devices.

The method of the invention further provides that, within a rolling campaign, a percentage of thin slabs 2 and a complementary percentage of thick slabs 3 are continuously fed in succession to the common rolling train 4 and rolled out—practically without interruptions, from the maintenance-related shutdown times. The specific number of thin slabs 2 and thick slabs 3 is determined on the basis of the given quality standard and the quality 10 of the hot-rolled strip 4*a* to be produced, a reduction of the roll wear, and a maximum production throughput. An example of such a ratio of thin slabs to thick slabs is one third thin slabs 2 to two thirds thick slabs 3. In the second process section, this type of "mixed rolling,"

i.e., the rolling of different slab thicknesses, generally leads to problems in the rolling process. These problems can be intensified by varying widths and steel grades. Larger numbers of geometric defects occur in the hot-rolled strip 4*a*. Increased roll wear is an especially important problem. The problems can be significantly reduced only by well-developed product engineering.

A contribution to this is made, for example, by the priority rolling of the thin slabs 2. As they emerge from the continuous casting machine 1, they are passed directly through the pusher furnace 5, with the roughing stands 4*c* open, and into the finishing rolling train 4 to be rolled out.

The thick slabs 3 are either cast on a remote continuous casting machine with a modified casting profile 15 of a continuous casting mold 14 or, preferably, are cast in an independent, possibly remotely installed, continuous casting installation on the basis of foresighted planning, and are removed from a temporary storage facility 7 for thick slabs 3 or thin slabs 2, which is located upstream of the walking-beam furnace 6, thermally prepared, conveyed in arrow direction 17 (general conveyance direction), and rolled out in the common finishing rolling train 4. The walking-beam furnace 6 is charged in a manner that is interrelated to the thick slabs 3, which are sorted according to width 8 and thickness 9. In this regard, it is already considered that the thick slabs 3 have already been cast according to the widths 8 and/or thicknesses 9 required for the final product and have then been placed in the temporary storage facility 7.

It is also possible for thick slabs 3 outside the limits of the entire rolling program of a pass line 4 to be cast for the average dimensions of the hot-rolled strip market and placed in temporary storage. The portion of thick slabs 3 is produced several days earlier than the casting of the thin slabs 2. This period of time makes it possible to produce all required widths 8 and thicknesses 9 without special production losses on a thick slab casting machine 1. The temporary storage facility 7 upstream of the walking-beam furnace 6 contains thicker slabs 3, which are provided for the planned rolling program, as well as transition slabs 16, which serve as "back-ups", so to speak, to cushion disturbances or short-term changes in the rolling program.

Figure 2:
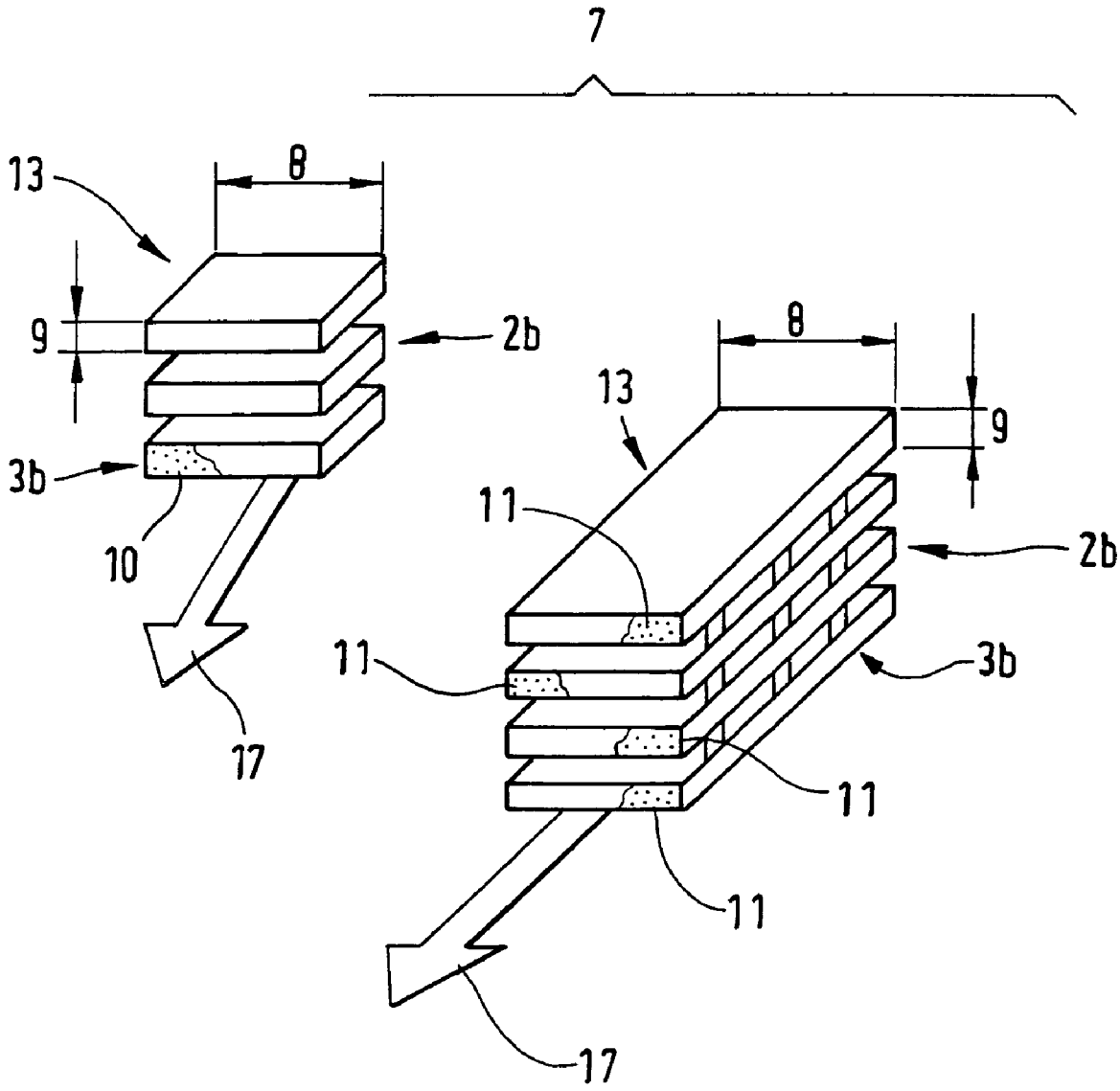
FIG. 2 shows a perspective view of the temporary storage facility for sorted slabs.

The thick slabs 3 or the thin slabs in the temporary storage facility 7 are sorted in stacks according to width 8, thickness 9, quality 10, and/or quality group 11 (see FIG. 2). During the execution of the planned rolling program, the casting machine 1 casts the thin slabs 2 with the required width 8 and thickness 9. Due to the direct charging of the thin slabs 2, the casting machine 1 receives the priority for thin slabs 2. The walking-beam furnace 6 has the second priority for thick slabs 3.

The finishing rolling train 4 basically decides at what time the hot thick slabs 3 are introduced into the pass line 4.

The walking-beam furnace 6 is operated as a function of the width 8, the thickness 9, and the quality 10 of a thin slab 2, so that an optimum strip geometry is obtained with the least possible roll wear. The types of stock in the temporary storage facility 7 allow this kind of flexibility.

In the downstream finishing rolling train 12, an intermediate product 13, which, in thickness 9 and width 8, was cast and rolled as a thin slab 2 or as a thick slab 3, is introduced at a point (see FIG. 1). Appropriate predetermined values for the equipment, e.g., the casting profile 15, or effects on the pass programs, were used for this purpose. For example, the continuous casting mold 14 can influence the casting profile 15 in width 8 and/or thickness 9 for optimum shaping for a transition slab 16. The continuous casting machine 1 and the rolling train 4 can be operated in the CSP process. The given continuous casting machine can also be operated with liquid core reduction (LCR). In accordance with further proposals of the invention, the thin slab 2 can be introduced into a roughing stand 4*c* of the rolling train 4, into which the thick slab 3 as well as the transition slab 16 can also be introduced.

A thin slab 2 or a thick slab 3, each with a thickness 9 of 30 mm to 60 mm, is introduced directly in front of the finishing rolling train 12 as a transition slab 16. A thin slab 2 is introduced with the same thickness 9 before the last roughing stand 4*c*. The transition slab 16 can be a thin slab 2 with or without deviation from the basic thickness or a reduced thick slab 3 introduced into the roughing stand 4*c*. It can also constitute a reduced thin slab 2 for the roughing stands 4*c*.

In the event that a thin slab 2 for special reasons cannot be introduced at the optimum points of the rolling train 4, it is provided that the thin slabs 2 are introduced before a roughing stand 4*c* with increased thickness with increasing distance from the finishing rolling train 4. The thickness of the thin slabs 2 is further increased, and the pass programs of the roughing stands 4*c* are adjusted. For example, two roughing stands 4*c* in tandem arrangement are operated for a thick slab 3 with a thickness 9 of 70 mm and/or the roughing stands 4*c* are opened.

The temporary storage facilities 7 can also consist, for example, of two stockpiles for thick slabs 3, each of which is sorted according to quality groups 11 and width classes. One group is provided for the product engineering, and one group is provided for operating states that cannot be planned.

LIST OF REFERENCE NUMBERS

1 continuous casting machine (for thin slabs)
2 thin slab
2*a* thin slab cross section
2*b* thin slab section
3 thick slab
3*a* thick slab cross section
3*b* thick slab section
4 rolling train (pass line)
4*a* hot-rolled strip
4*b* finishing rolling stand
4*c* roughing rolling stand
5 pusher furnace
6 walking-beam furnace
7 temporary storage facility for thick, thin slab sections
8 width of a (thick) slab
9 thickness of a (thick) slab
10 quality
11 quality group
12 finishing rolling train
13 intermediate product
14 continuous casting mold
15 casting profile
16 transition slab
17 arrow direction
18 coils

The invention claimed is:

1. Method for rolling thin and thick slabs (2; 3) made of steel materials into hot-rolled strip (4*a*), which slabs (2; 3) were previously cast in a continuous casting machine (1), comprising the steps of: heating the thin slabs to rolling temperature in a pusher furnace (5) and heating the thick slabs to rolling temperature in a walking-beam furnace (6); rolling the slabs in a common rolling train (4) into strip; and cooling and winding the strip into coils (18), wherein successive thin slab sections (2*b*) from a single thin slab continuous casting machine (1), which emerge from the pusher furnace (5), or thick slab sections (3*b*) which emerge from the walking-beam furnace (6) and are introduced transversely into the rolling train (4), are continuously selectively passed directly into reducing roughing stands (4*c*), which reduce thickness (9) of the slabs, through open roughing stands (4*c*) or directly in front of a first rolling stand of a finishing rolling train (12), finish rolled in the finishing rolling train (12) located in a pass line with the roughing stands (4*c*), and only then wound into coils (18).

2. Method in accordance with claim 1, wherein, within a rolling campaign, a percentage of thin slabs (2) and a complementary percentage of thick slabs (3) are continuously fed in succession to the common rolling train (4) and rolled out, and the specific number of thin slabs or thick slabs (2; 3) is determined on the basis of the given quality standard of the hot-rolled strip (4*a*) to be produced, a reduction of the roll wear, and a maximum production throughput.

3. Method in accordance with claim 1, wherein the thin slabs (2) receive rolling priority and, as they emerge from the continuous casting machine (1), are passed directly through the pusher furnace (5), and, with the roughing stands (4*c*) open, into the finishing rolling train (4) to be finish rolled.

4. Method in accordance with claim 1, wherein the slabs (2; 3) are removed from a temporary storage facility (7) for thick and/or thin slabs (2; 3), which is located upstream of the walking-beam furnace (6), thermally prepared, and rolled out in the finishing rolling train (4) located in a common pass line.

5. Method in accordance with claim 4, wherein the walking-beam furnace (6) is charged in a manner dependent on the thick slabs (3), which are sorted according to width (8) and thickness (9).

6. Method in accordance with claim 1, wherein the thick slabs (3) are cast and placed in temporary storage in a manner that is related to required widths (8) and/or thicknesses (9).

7. Method in accordance with claim 1, wherein thick slabs (3) outside the limits of an entire rolling program of a pass line (4) are cast for average dimensions of a hot-rolled strip market and placed in a temporary storage facility.

8. Method in accordance with claim 7, wherein the thick or thin slabs (3; 2) are sorted in the temporary storage facility (7) according to width (8), quality (10), and/or quality groups (11).

9. Method in accordance with claim 1, wherein in a downstream finishing rolling train (12), an intermediate product (13) is introduced, which was cast and/or roughed in thickness (9) and width (8) as an approximately thin slab (2) or an approximately thick slab (3).

10. Method in accordance with claim 9, wherein continuous casting molds (14) are used to dimension a casting profile (15) in width (8) and/or in thickness (9) for optimum shaping of the intermediate product (13).

11. Method in accordance with claim 1, wherein the continuous casting machine (1) and the rolling train (4) are operated in a compact strip production (CSP) process.

12. Method in accordance with claim 1, wherein the continuous casting machine (1) is operated with liquid core reduction (LCR).

13. Method in accordance with claim 1, wherein the thin slab (2) is introduced between two roughing stands (4*c*) of the finishing rolling train (4), into which a thicker slab (3) is introduced as a transition slab (16).

14. Method in accordance with claim 13, wherein a thin slab (2) or a thick slab (3), each with a thickness (9) of 30 mm to 60 mm, is introduced into the pass line (4) as a transition slab (16).

15. Method in accordance with claim 1, wherein as thickness (9) of the thin slab (2) increases, the thin slab (2) is introduced between two roughing stands (4*c*) with increasing distance from the finishing rolling train.

* * * * *